United States Patent [19]

Cobb et al.

[11] Patent Number: 4,746,222

[45] Date of Patent: May 24, 1988

[54] MIXING AND COOLING APPARATUS FOR HOT, PARTICULATE MATTER

[75] Inventors: Delwin E. Cobb, Macomb, Ill.; Chien-Cheng J. Shih, Irvine; Charles F. Griswold, Brea, both of Calif.

[73] Assignee: Union Oil Company of California, Los Angeles, Calif.

[21] Appl. No.: 115,165

[22] Filed: Oct. 30, 1987

[51] Int. Cl.[4] ..... B01F 7/16; B01F 15/06

[52] U.S. Cl. ..... 366/147; 366/171; 366/172; 366/293; 366/305; 366/307; 366/343

[58] Field of Search ..... 366/9, 64, 65, 66, 97, 366/98, 144, 147, 167, 168, 171, 172, 173, 279, 270, 262, 263, 292, 293, 302, 305, 307, 340, 315–317, 325, 330, 337, 338, 342, 343

[56] References Cited

U.S. PATENT DOCUMENTS

| | | | |
|---|---|---|---|
| 1,102,696 | 7/1914 | Shiner | 366/305 X |
| 1,132,702 | 3/1915 | Chandler | 366/305 X |
| 1,574,210 | 2/1926 | Spaulding | 366/340 X |
| 2,204,029 | 6/1940 | Russell | 366/305 |
| 2,345,554 | 4/1944 | Burdett | 366/337 X |
| 2,546,691 | 3/1951 | Green | 366/293 |
| 2,804,379 | 8/1957 | Wistrich et al. | 366/305 X |
| 3,045,984 | 7/1962 | Cochran | 366/340 |
| 3,275,304 | 9/1966 | Brundrett | 366/337 |
| 3,337,194 | 8/1967 | Zavasnik et al. | 366/337 |
| 3,395,898 | 8/1968 | Westelaken | 366/337 X |
| 3,771,594 | 11/1973 | Bornemann | 366/147 X |
| 3,988,211 | 10/1976 | Lewandowski et al. | 202/227 |
| 4,099,267 | 7/1978 | King | 366/173 X |
| 4,207,009 | 6/1980 | Glocker | 366/340 X |
| 4,437,936 | 3/1984 | Jung | 202/227 X |
| 4,448,134 | 5/1984 | Foote | 366/340 X |
| 4,483,624 | 11/1984 | Bacon, Jr. et al. | 366/293 |
| 4,556,458 | 12/1985 | Deering et al. | 202/227 |
| 4,597,852 | 7/1986 | York et al. | 366/337 X |

FOREIGN PATENT DOCUMENTS

| | | | |
|---|---|---|---|
| 6014 | 5/1907 | United Kingdom | 366/338 |
| 581849 | 10/1946 | United Kingdom | 366/337 |

OTHER PUBLICATIONS

Parachute Creek Shale Oil Program, Union Oil Company of California.

(List continued on next page.)

*Primary Examiner*—Timothy F. Simone
*Attorney, Agent, or Firm*—Howard R. Lambert; G. Wirzbicki; D. Sandford

[57] ABSTRACT

Apparatus for the mixing and cooling of hot, particulate matter, such as hot, retorted oil shale, comprises a plurality of enclosed, vertically spaced apart, converging vessels through which the material to be mixed and cooled is flowed. At least the lowermost vessel is configured for a packed bed flow of the material and has mounted therein, on a vertical drive shaft, a mixer blade assembly having a plurality of similar mixing blades which are upwardly inclined at an angle, $A_1$, of between about 30° and about 75° and preferably within about ±15° of the sidewall angle of the vessels. The blades are mounted so as to have an angle of attack, $A_2$, relative to the rotational direction of travel, of between about 20° and about 60°. A constant angle of attack along each mixing blade is assured by making the angle, $A_3$, between the blade leading edge and the blade base to be related to the blade inclination and attack angles in accordance with the relationship:

$$A_3 = \text{Arctan}\,[\tan(90° - A_2)/\cos A_1].$$

Leading and trailing edges of the blades are beveled to reduce frictional drag on the blade during operation, the leading edges being made as sharp as practical. Blade length is related to vessel diameter at tips of the blades and interblade spacing is related to maximum size of particles to be mixed by the apparatus. Means are included for spraying a cooling fluid, such as water, onto the material as it flows downwardly through the apparatus.

54 Claims, 3 Drawing Sheets

OTHER PUBLICATIONS

In-Bin Blending, J. R. Johanson, Chemical Engineering Progress, Jun. '70, (vol. 66, No. 6—pp. 50-55).

Controlling Flow Patterns in Bins by Use of An Insert, J. R. Johanson, Bulk Solids Handling, Sep. 1982, (vol. 2, No. 3—pp. 495-498).

The Use of Flow-Corrective Inserts in Bins, by J. R. Johanson, Transactions of the ASME, May, 1966 (pp. 224-230).

An Overview of Oil-Shale Retorting Processes, Arthur E. Lewis and Robert L. Braun, Energy Research (pp. 1-17).

Ross Motionless Mixers, Charles Ross & Son Company; Long Island, New York.

The Simulation of a Particle Disperser, M. H. Cooke and J. Bridgwater; Great Britain, Powder Technology No. 33, 1982 (pp. 239-247).

158
16
52
74
14
100
104
156
A1
106
108
18
73
50
54
64
160
102
84
86
76a
56
66
88
90
92
D
94
58
76
124
142
120
128
140
144
122
126
A6
68
70
72
20
22

MIXING AND COOLING APPARATUS FOR HOT, PARTICULATE MATTER

BACKGROUND OF THE INVENTION

1. Field of the Invention

The present invention relates generally to apparatus and methods for mechanically mixing and cooling a flow of particulate matter and more particularly to such apparatus and methods for mixing and cooling a packed bed flow of hot, retorted oil shale.

2. Background Discussion

Oil shales are sedimentary rocks containing solid, combustible organic material in a mineral matrix. This organic material, termed kerogen, is largely insoluble in petroleum solvents but, when heated in the absence of oxygen, decomposes to yield an oil similar to natural crude oil. Such oil shales are plentiful throughout the world and represent a vast, albeit a low grade, reserve of oil. According to recent estimates, oil shales capable of yielding between about 25 and 100 gallons of oil per ton (GPT) represent a worldwide oil reserve of about $9\times10^{11}$ barrels (at 42 gallons per barrel). Considering all shales capable of yielding more than about 5 GPT, the worldwide shale oil reserve is estimated at about $5.5\times10^{12}$ barrels. By comparison, the 1975 estimate of the world's reserve of natural crude oil was about $7\times10^{11}$ barrels.

In addition to its vast oil reserve potential, shale oil, of all presently known alternative crude oils (generically referred to as "syncrudes"), most closely resembles natural crude oil. Using present technologies, a suitable feedstock for existing crude oil refineries can reportedly be produced from shale at a lower cost than from other syncrude sources.

According, for example, to the McGraw-Hill Encyclopedia of Energy, Second Edition, 1977 (pages 494–500), an estimated twenty percent of the United States' land mass overlies oil shale. The world's largest single shale oil reserve is believed to be the Eocene Green River Formation which covers about 16,500 square miles in Colorado, Utah and Wyoming. This particular formation is estimated to have an oil potential in excess of about $2\times10^{12}$ barrels, of which about $6\times10^{11}$ barrels are considered to reside in deposits having a potential of at least about 25 GPT. This latter reserve estimate for just the Green River Formation is about 20 times the recently estimated total natural crude oil reserves in this country.

Historically, in the late 1800's and early 1900's, substantial amounts of shale oil were reportedly produced in Europe. However, since then, when inexpensive crude oil started becoming readily available, it has almost always been the case that producing oil from shale has been more costly, and usually much more costly, than producing natural crude oil. Consequently, only in unusual circumstances, such as during World War II when the demand for petroleum products exceeded the amount of natural crude available and cost was not a controlling factor, has the production of oil from shale been known to be carried out on any substantial basis. After World War II, when cheap natural crude oil again became plentiful, interest in more costly shale oil decreased and remained low until the mid-east crises of the 1970's and the emergence of strong oil cartels caused a dramatic increase in the price of crude oil. In direct response thereto, and in the expectation that natural crude oil prices would continue to escalate, interest was renewed in all types of syncrudes, including shale oil. However, most, but not all, of this renewed interest in shale oil, along with other synfuels, lasted only until conservation practices and a general recession throughout the world, precipitated by the huge crude oil price increases of the mid-1970's and the resulting inflation, caused natural crude oil surpluses and a substantial fall in crude oil prices.

The commercially unattractive, high cost of producing shale oil, as compared with the cost of extracting natural crude oil from the ground or buying it abroad, is the result of many difficult technical and environmental problems, some of which are mentioned in the above-referenced McGraw Hill Encyclopedia of Energy at pages 18, 19 and 59. In turn, most of these problems relate, either directly or indirectly, to the large amounts of even high grade oil shale which must be extracted from the ground and processed to produce even moderate amounts of shale oil. As an example of the magnitude of this task, a moderate production rate of about 10,000 barrels of oil a day (BPD) from relatively high grade oil shale can be expected to require the mining and processing of between about 15,000 and 20,000 cubic yards (about 12,500 to 16,800 tons) of shale a day. Substantially greater amounts of lower grade shale must, of course, be extracted and processed to produce this amount of shale oil.

After being extracted from the ground, for example, by conventional room and pillar mining techniques, the large pieces of shale must generally be crushed into relatively small pieces (for example, into about two or three inch pieces) before the shale can be effectively retorted to convert the kerogen in the shale into a usable crude oil. However, shale crushing generally requires expensive crushing equipment because the high organic content of the shale makes the shale difficult to crush.

After being crushed to a relatively small size, the shale must then be retorted at a high temperature to extract the oil which must still, thereafter, be refined in the manner of natural crude oil. Retorting temperatures of several hundred degrees F. are typically required, but to obtain a high grade oil, which is low in olefins and saturates, retorting temperatures as high as about about 700° F. to 1000° F. are usually needed. Practical retort operation, to achieve a reasonable shale throughput rate, virtually dictates a continuous or substantially continuous feeding of shale into and through the retort, as opposed to batch processing. Very difficult problems are, however, typically associated with uniformly heating to a high temperature a large, continuous flow of shale through a retort in a manner which converts at least most of the kerogen in the shale to oil, it being obvious that the lower the yield, the more shale must be processed.

Because, at least employing present retorting processes, significant amounts of unconverted kerogen remain in the retorted shale and because a certain amount of shale coking inevitably occurs as a result of high temperature retorting, still other problems are commonly encountered with the safe and environmentally acceptable disposal of the hot retorted shale. In this regard, the amount of retorted shale to be disposed of amounts to about 80 weight percent of the amount of shale fed into the retort and the volume of the retorted shale is typically greater than that of the non-retorted shale.

If retorted shale is exposed to air at retort temperatures or, for that matter, at temperatures above about 500° F., the kerogen and coke content can be expected to cause the shale to spontaneously ignite and start burning. Such burning of discharged, hot retorted shale makes the shale more difficult to dispose of and also may create environmental pollution problems. In some areas, such burning of retorted shale may be illegal. Consequently, retorted shale must ordinarily be cooled to a temperature of under about 500° F. (assuming a retorting temperature higher than 500° F.) before the shale can be safely and/or legally discharged and exposed to air.

In one known manner of cooling hot, retorted oil shale, the shale is discharged directly from the retort into a closed cooling system which comprises a cooling vessel or series of cooling vessels. Cooling water is sprayed onto the shale as it flows downwardly, under gravity, through the vessel or vessels. Presumably, by the time the shale flows through the vessel or vessels, it will have been sufficiently cooled to enable its discharge into the open. Exemplary apparatus for such shale cooling is disclosed in U.S. Pat. Nos. 4,556,458 to Deering et al. and 4,519,458 to Bertram.

It should be apparent that when high retorting temperatures are used, the shale requires substantial cooling. To achieve the amount of shale cooling needed under such circumstances, it is generally necessary to augment the cooling process by mixing the shale as it flows through the cooling vessel or vessels. Otherwise, the shale flow path may be required to be greater than can practically be provided because of space restrictions. Problems have, nevertheless, still been encountered with providing the amount of mixing needed to enable the adequate and efficient cooling of hot, retorted oil shale, particularly when the shale transit time and/or its travel path through the cooling vessels is limited by preexisting cooling system dimensional constraints.

Moreover, the wide range of retorted shale particle sizes, apparently caused by the shale being crushed and ground as it is fed through the retort, makes most retorted shale even more difficult to cool. This is because the small particles and fines fill otherwise open regions between larger shale pieces and block the flow of cooling water to these larger pieces. Furthermore, the fines and small particles tend to cling together and are difficult to wet.

In the absence of thorough and effective shale mixing in conjunction with water spray cooling, discrete regions or pockets of hot, essentially uncooled shale may exist and become entrained in the flow of retorted shale through the cooling vessel, as may regions or pockets of excessively wet shale. Whenever such pockets of uncooled shale and excessively wet shale encounter one another, the excess water may be explosively flashed into steam. The pressure surges caused by this steam flashing impedes both the flow of shale and the cooling process. Moreover, the pressure surges may feed back into the retort and disrupt the shale retorting process. Alternatively, or in addition, the pockets of uncooled shale can, upon discharge from the cooling system, spontaneously ignite, as described above, and regions of excessively wet shale can cause bridging in the cooling system, thereby further impeding the shale flow and/or cooling process.

An amount of shale mixing, insufficient to prevent the above-described problems associated with the formation of pockets of uncooled shale and excessively wet shale, usually cannot practically be compensated for by merely increasing the amount of cooling water used. The mechanisms causing the regions or pockets of uncooled shale are, for example, not significantly changed by adding more water, and the use of more water may increase, rather than decrease, the incidence of pressure surges caused by the mentioned flashing of water into steam and the amount of shale bridging. Furthermore, in many regions where oil shale may be mined and processed, the supply of water is limited and large amounts of water for shale cooling may not be available or may be prohibitively expensive. Even when water is available, the use of excessive amounts of water still adds to the cost of the shale cooling process, and thereby to the overall cost of shale oil production, when, in fact, shale oil production costs need to be reduced.

In spite of improvements which have been made to apparatus for mixing and cooling hot, retorted oil shale, additionally improved mixing and cooling apparatus are still sometimes required, especially for oil shale processing facilities in which the allocation of space or other constraints make the mixing and cooling of the retorted shale particularly difficult. It is, therefore, a principal objective of the present invention to provide such additionally improved apparatus which may be used to augment existing shale mixing and cooling apparatus and/or which may be used by itself for the effective mixing and cooling of hot, retorted oil shale or the like.

SUMMARY OF THE INVENTION

Particulate matter mixing and cooling apparatus, according to the present invention, comprises generally a flow-through mixing vessel and mechanical mixing means disposed in the vessel for mixing particulate material which flows through the vessel in a packed bed flow. Sides of the vessel preferably converge at an angle of between about 35° and about 75°, and more preferably at an angle of about 60°, relative to a horizontal plane.

The mixing means include a mixer shaft to which is connected a plurality, preferably between about 4 and about 8, similar mixing blades and also include drive means for causing rotation of the shaft. The mixer shaft is mounted for rotation along the vertical axis of the vessel with a first, blade mounting portion disposed within a packed bed flow region of the vessel. Shaft drive means are connected to a second portion of the shaft which is outside the packed bed flow region of the vessel.

According to a preferred embodiment, means are included for introducing a cooling fluid, such as water, onto the particulate matter as it flows downwardly through the vessel.

Means are disposed upstream of the mixing blades and inwardly of major portions of the blades for at least partly supporting the weight of particulate matter in the vessel and for diverting the flow of particulate matter outwardly towards the mixing blades when the blades are rotated with the shaft.

The mixing blades, preferably in the shape of a parallelogram, are connected to the mixer shaft, preferably in a symmetrical manner, so that each blade is upwardly and outwardly inclined, with respect to a plane orthogonal to the vessel's vertical axis, at an average inclination angle, $A_1$, which is preferred to be between about 30° and about 75°, and which is more preferably about equal to the angle of the sides of the vessel.

In the preferred embodiment, the leading edge of each mixing blade has an average angle of attack, $A_2$, with respect to its instantaneous direction of travel (i.e., with respect to a tangent to a horizontal arc which originates at the vessel vertical axis) preferable of between about 20° and about 60° and still more preferably of about 45°. Preferably, an angle, $A_3$, between the leading edge of each blade and its base is related to the blade angle of inclination, $A_1$, and blade angle of attack, $A_2$, by the expression:

$$A_3 = \text{Arctan}\,[\tan(90° - A_2)/\cos A_1].$$

It is also preferred that each mixing blade is substantially flat, with parallel inwardly and outwardly facing surfaces, and that the outer surface is beveled at both leading and trailing edges. The leading edge bevel angle is preferably between about 20° and about 60°, and is more preferably about 30°.

Also, in the preferred embodiment, the length, L, of each blade is determined by the relationship:

$$L = K_1 D,$$

wherein D is the average diameter of the mixing vessel in the region of distal ends of the mixing blades and $K_1$ is a blade length factor having a preferred value of between about 0.15 and about 0.35, and more preferable of about 0.24. Moreover, in the preferred embodiment, the maximum separation distance, $d_1$, between adjacent mixing blades is given by the relationship:

$$d_1 = K_2 P_{max},$$

wherein $P_{max}$ is the maximum cross-sectional dimension of particles to be mixed in the apparatus and $K_2$ is a blade separation factor preferably of at least about 3. It is still further preferred that the clearance distance between the blades and surrounding regions of the vessel is less than about one foot.

In the preferred embodiment of the invention, one or more cascade flow mixing vessels may be disposed upstream of the packed bed mixing vessel. Also, when particulate matter is discharged into the uppermost mixing vessel through a conduit at an angle substantially less than 90° relative to the horizontal, flow spreading means, preferably having a flat, partially elliptically shaped flow surface, are included in the conduit, at its outlet end, for spreading the flow of particulate matter discharged from the conduit.

BRIEF DESCRIPTION OF THE DRAWINGS

A better understanding of the present invention may be had from the following detailed description when taken in conjunction with the accompanying drawings in which.

DESCRIPTION OF THE PREFERRED EMBODIMENT

Figure 1:
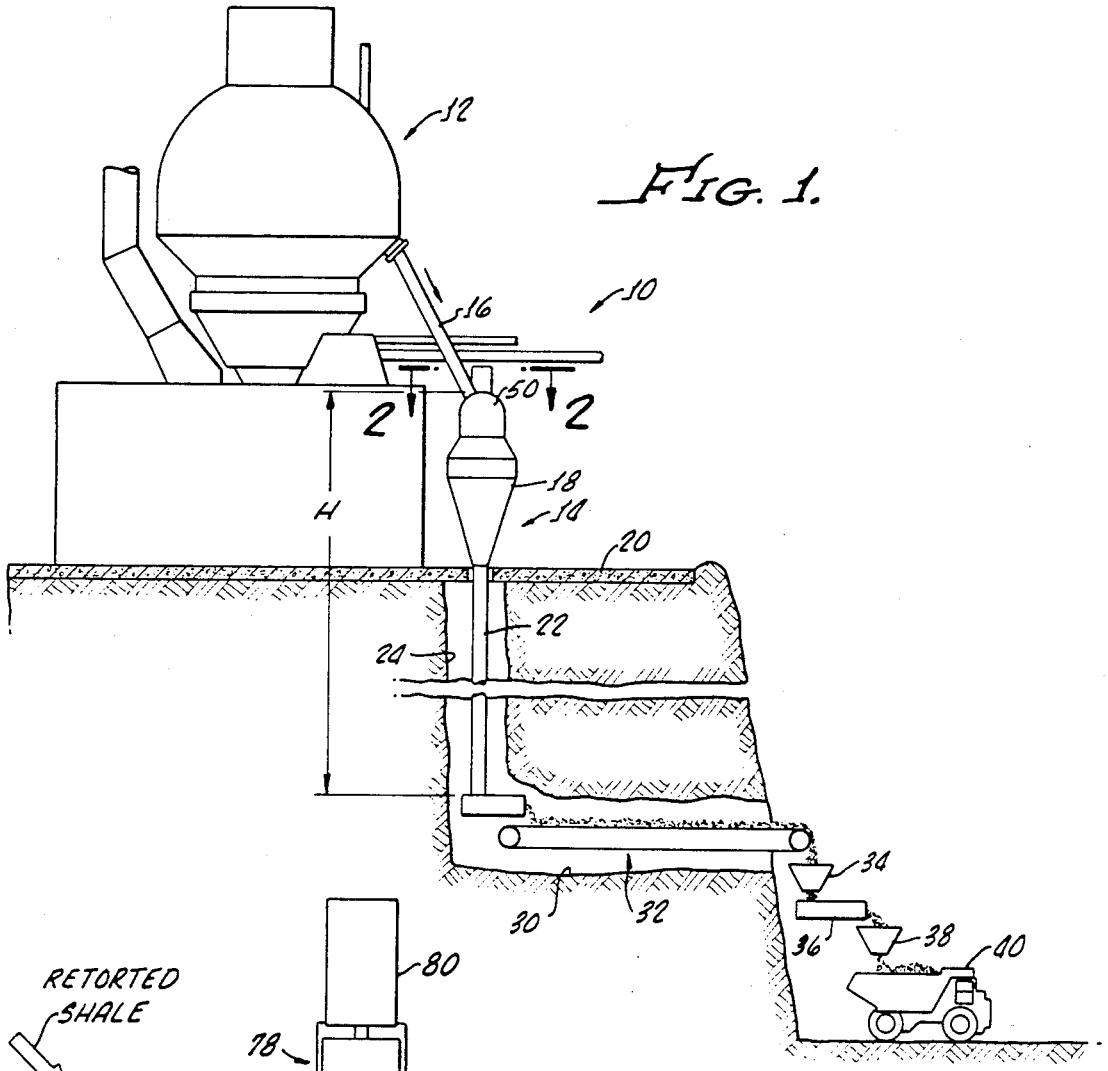
FIG. 1 is a pictorial diagram showing a representative shale oil retorting and shale cooling facility which includes an oil shale retort and, connected thereto in a shale receiving relationship, the shale mixing and cooling apparatus of the present invention.

There is depicted in FIG. 1 an exemplary shale oil retorting and shale cooling facility 10 in which the present invention may be used to advantage. Generally comprising system 10 are an upflow oil shale retort 12 and a shale mixing and cooling apparatus 14, according to the present invention. Apparatus 14 is connected, by a pair of conduits 16 (FIG. 2), to retort 12 for receiving therefrom, by gravity flow, hot, retorted oil shale. As shown by way of example, an upper portion 18 of mixing and cooling apparatus 14 extends above a ground surface 20 on which retort 12 is mounted and a lower portion 22 of the apparatus extends downwardly into and through a vertical shaft 24 excavated in the earth.

A drift 30 through the mountainside is shown intersecting lower regions of shaft 24. Installed in drift 30 are conveyor means 32, such as a belt or screw conveyor, for conveying cooled oil shale discharged from the lower end of mixing and cooling apparatus 14 to an outside shale hopper 34. From hopper 34, a short conveyor 36 transports the shale to a second hopper 38 which discharges the shale into a transport vehicle 40 used to haul the cool retorted shale to a disposal site. The overall height, H, of apparatus 14 may, for example, be about 160 feet.

Figure 2:
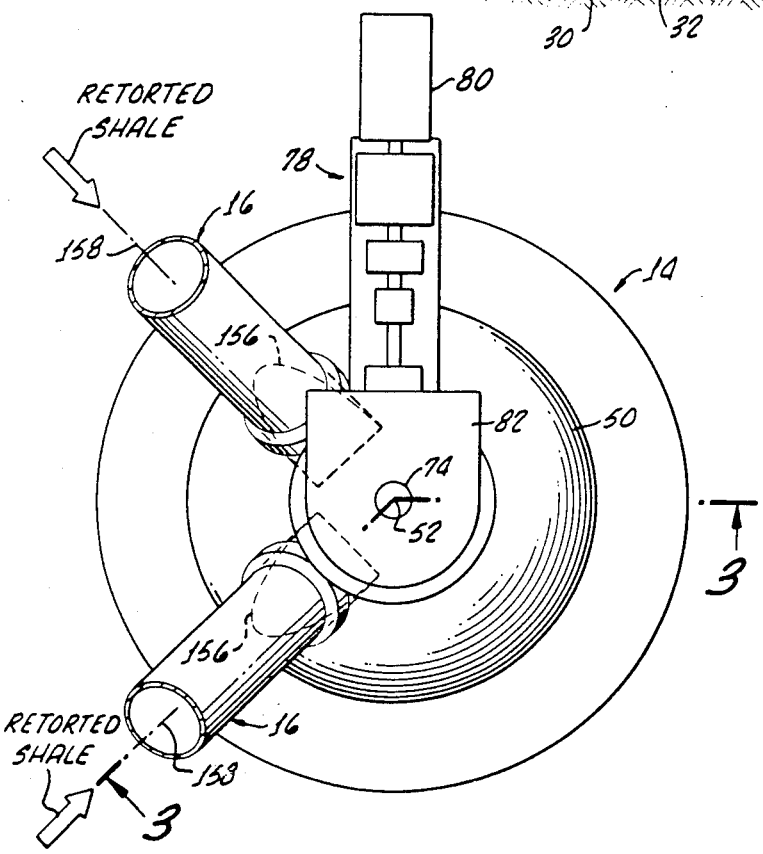
FIG. 2 is a transverse cross-sectional view, taken along line 2—2 of FIG. 1, looking down onto the top of the shale mixing and cooling apparatus.
Figure 3:
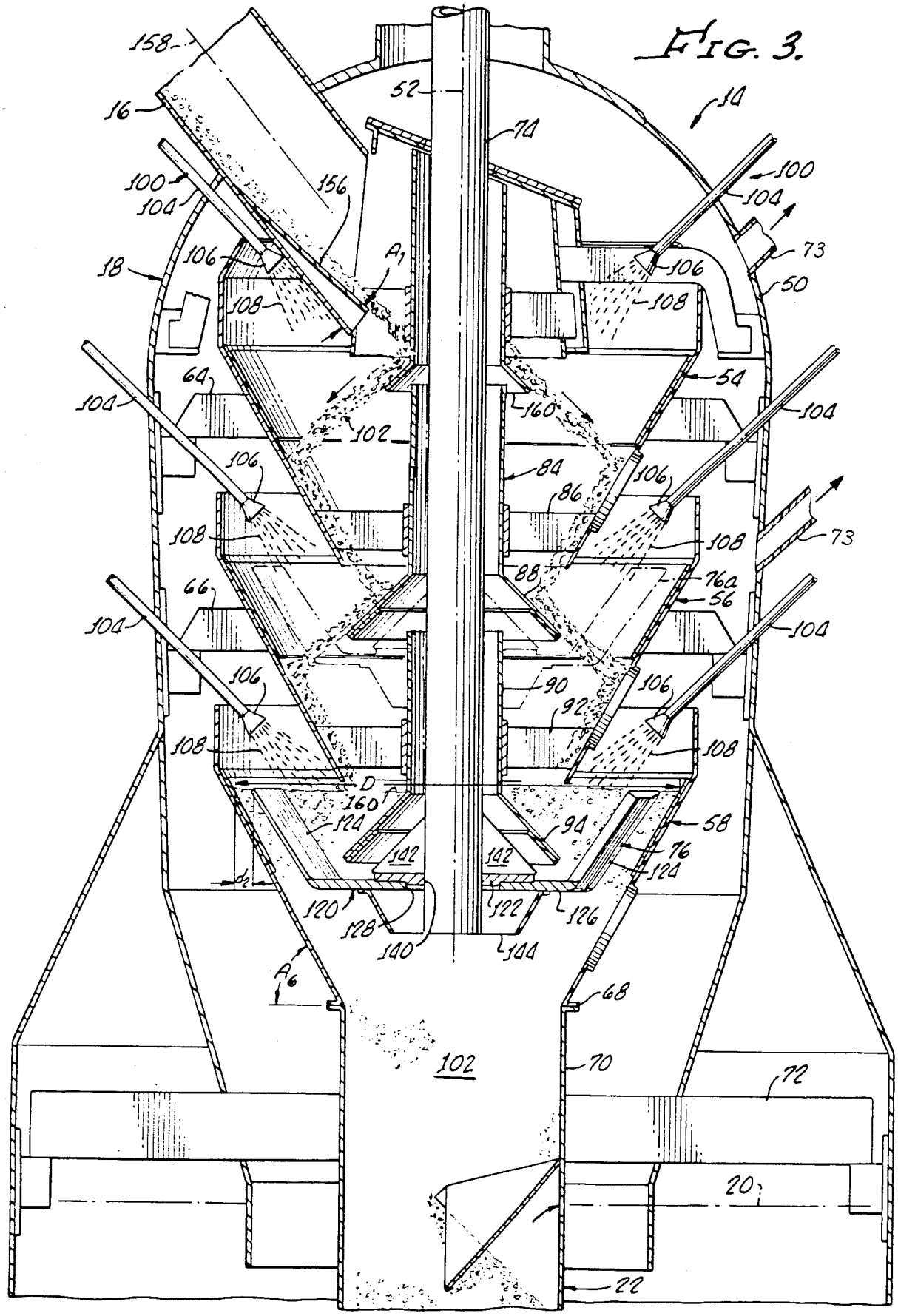
FIG. 3 is a vertical cross-sectional view, taken along line 3—3 of FIG. 2, showing three vertically arranged mixing vessels or chambers and a mixing blade assembly mounted in the lowermost one of the vessel, through which the shale moves under gravity in a packed bed flow.

Upper portion 18 of shale mixing and cooling apparatus 14 comprises, as shown in FIG. 3, a substantially closed, generally cylindrical housing or shell 50 having a hemispherically-shaped dome through which shale feeding conduits 16 inwardly extend at an angular separation of about 90° (FIG. 2). Installed coaxially with a vertical axis 52 of housing 50 (and, as well, of apparatus 14) is a plurality of converging mixing vessels or hoppers arranged in material flow series, one above another, along such axis, there being shown an upper vessel 54, an intermediate vessel 56 and a lower vessel 58. Although three such vessels 54, 56 and 58 are shown, it is to be appreciated that more or fewer than three vessels may alternatively be provided. Preferably, as shown, vessels 54, 56 and 58 are slightly nested so that open, lower regions of the upper vessel extend downwardly into open, upper regions of the intermediate vessel and open, lower regions of the intermediate vessel, in turn, extend downwardly into open, upper regions of the lower vessel.

Preferably, for economy of manufacture, all vessels 54, 56 and 58 are substantially the same size and shape, each having converging sidewalls and each being thereby shaped generally like an inverted frustrum of a right cone, with each vessel having an axially short cylindrical upper end region which is substantially larger in diameter than an open circular lower end. Upper vessel 54 is supported from housing 50 by an annular, upper support assembly 64 and intermediate vessel 56 is similarly supported from the housing by an annular intermediate support assembly 66. Lower vessel 58 has its open lower end connected, at flanges 68, to apparatus lower portion 22 which may, for example, comprise a mixing tube 70 described in copending application Ser. No. 815,914, filed on Jan. 3, 1986, which is herein incorporated in its entirety by specific reference. A lower support assembly 72 supports lower vessel 58 and mixer portion 22 from ground surface 20.

A plurality of venting conduits 73 (FIG. 3) are connected through the side of housing 50 to enable steam created in apparatus 14 during the shale cooling process (described below) to be discharged. Some volatiles, which may be carried along with the shale from retort 12 into apparatus 14, may also be discharged through venting conduits 73, as may some fine particulate material which is carried along with the escaping steam. Typically, venting conduits 73 are connected to scrubbers or other conditioners (not shown) which remove contaminants from the steam before the steam is discharged into the atmosphere.

Installed downwardly into housing 50, along axis 52, is a rigid, vertical mixer shaft 74 (FIGS. 2, 3, 5 and 6). Fixed to shaft 74 so as to be within lower vessel 58, is a mixer blade assembly 76 (FIGS. 3 and 6), which is more particularly described below. Although, for reasons of minimizing shaft drive torque and power, it is usually preferred that only lower vessel 58 have mixer blade assembly 76 installed therein, a similar mixer blade assembly **76*a* (shown in phantom lines in FIG. 3) may, if needed for additional mixing, be fixed to shaft 74 so as to be within intermediate vessel 56. Connected to the upper end of shaft 74 are shaft drive means 78 which comprise a drive motor 80 and a gear box/transmission 82 (FIG. 2**).

An upper, tubular shaft protector 84, installed around shaft 74 in the region of upper vessel 54, is connected, by an internal support assembly 86, to lower, inner regions the upper vessel (FIG. 3). Connected to the lower end of shaft protector 84 is a diverging particulate material flow divertor 88 which extends a susbstantial distance downwardly into intermediate vessel 56. Similarly, an intermediate, tubular shaft protector 90, installed around shaft 74 below member 84, is connected by an internal support assembly 92 to lower, inner regions of intermediate vessel 56. A diverging particulate material flow divertor 94, similar to divertor 88, is connected to the lower end of shaft protector 90 and extends downwardly into lower vessel 58, to just above mixer blade assembly 76. Such flow divertor 94 not only diverts the flow of particulate material outwardly towards mixing portions of mixer blade assembly 76, but importantly supports at least part or most of the weight of the particulate material in lower vessel 58, and thereby reduces the driving torque required for shaft 74.

Cooling means 100, which are included in apparatus 14, enable a cooling fluid, such as water, to be sprayed onto and into particulate material 102 flowing downwardly, under gravity, though vessels 54, 56 and 58. Comprising cooling means 100 are a number of cooling fluid conduits 104 which extend through housing 50 into upper regions of vessels 54, 56 and 58. An inner end of each such cooling fluid conduit 104 has connected thereto an adjustable spray nozzle 106 which directs a spray 108 of fluid from the conduit downwardly onto the exposed surface of material 102 as the material flows downwardly into and through vessels 54, 56 and 58. Preferably, each vessel 54, 56 and 58 has associated therewith several conduits 104 and spray nozzles 106, arranged around the vessel at equal or about equal angular spacings, only two of the conduits and nozzles, however, being shown in FIG. 3 for each vessel. Alternatively, although not shown, each vessel 54, 56 and 58 may have associated therewith a ring-shaped discharge conduit which has connected thereto a number of spray nozzles corresponding to nozzles 106.

Cooling fluid inlet ends of conduits 104 are connected to a common conduit or manifold which is, in turn, connected to a pressurized source of cooling fluid, neither the interconnecting manifold nor cooling fluid source being shown. When the cooling fluid is water, the source of cooling liquid is preferably a conventional or preexisting facility water main.

MIXER BLADE ASSEMBLY 76

Mixer blade assembly 76 provides for the mixing of material 102 as the material travels through lower vessel 58 in a packed bed flow (FIG. 3). The configuration of blade assembly 76, shown more particularly in FIGS. 4–7 and which is described below, has been determined by the present inventors to cause an efficient mixing of material 102 by uplifting and circulating the material as it flows through vessel 58, thereby also reducing the driving torque which must be applied to shaft 74 by driving means 78.

Figure 4:
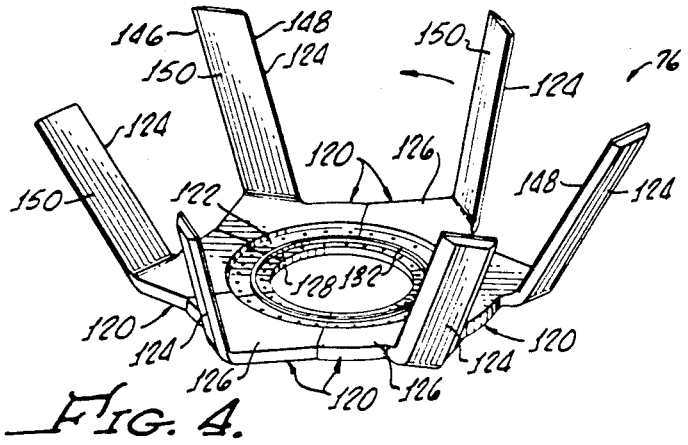
FIG. 4 is a perspective drawing of the mixing blade assembly of FIG. 3 showing the general configuration of the blade assembly.
Figure 5:
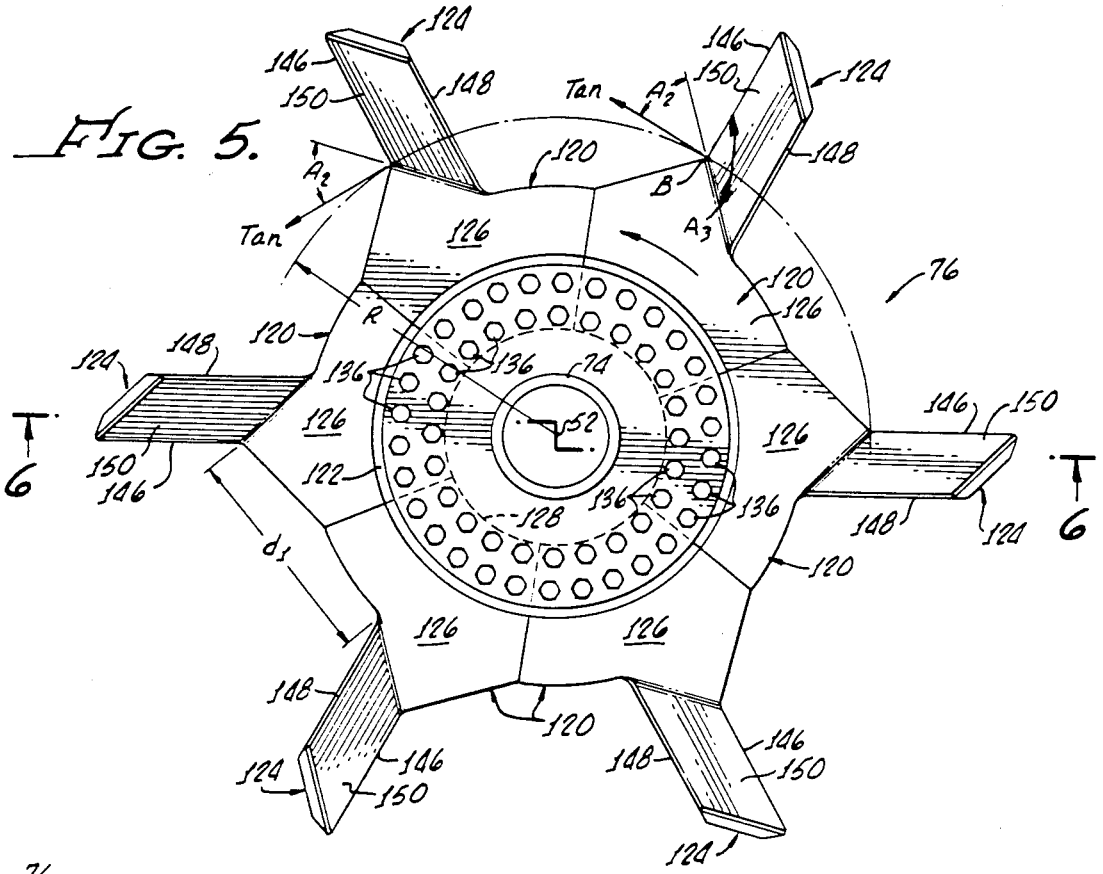
FIG. 5 is a plan view of the mixing blade assembly of FIG. 4 showing the symmetrical arrangement of the mixing blades and the angle of attack of the blades relative to the direction of blade rotation.
Figure 6:
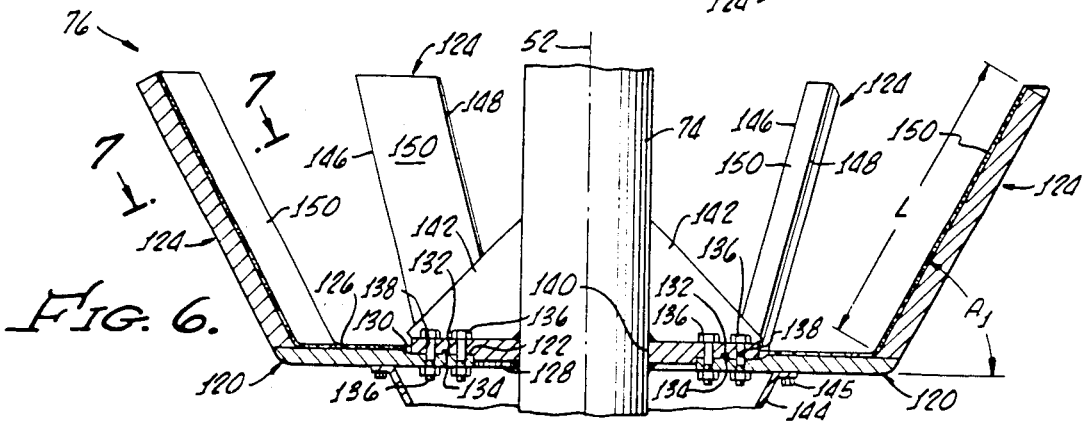
FIG. 6 is a transverse cross-sectional view, taken along line 6—6 of FIG. 5, showing the angle of inclination of the blades relative to a horizontal plane.

Shown comprising blade assembly 76 is a plurality of similar, and preferably identical, blade sectors 120 and an annular blade interconnecting and mounting ring 122 (FIG. 5). As shown in FIGS. 4–6, six blade sectors 120, each having one mixer blade 124, are preferably provided, in which case each segment extends for 1/6 of a circle, or 60°. However, as few as about 4 and as many as 8 or even more blade sectors 120 may be provided, depending upon the size of blade assembly 76 and vessel 58, and also upon the size and characteristics of particulate material 102 to be mixed thereby. With respect to the above-mentioned, preferred minimum number of mixer blades, the present inventors have determined that when four or more mixer blades are used, the blades do not function entirely independently of one another during the mixing operation. Consequently, less driving torque is required than when fewer than four blades are used and each blade functions entirely independently of one another.

Several advantages are associated with forming blade assembly 76 from a plurality of individual blade sectors 120, each having a single mixer blade 124. For example, if one mixer blade 124 breaks, the sector 120 having that blade can be replaced with a spare sector while the broken or damaged sector is being repaired. Also, only blade sectors 120 need to be stocked as spares and not entire blade assemblies 76. Moreover, for large apparatus 14, entire blade assembly 76 may be very large and heavy and difficult to manufacture as one piece. In contrast, individual blade sectors 120 are much easier to machine and handle in the manufacturing stage than the entire assembly 76. Furthermore, although all blade sectors 120 are preferably identical to one another, constructing blade assembly 76 from a plurality of individual blade sectors enables the substitution of different blade configurations, as may be desirable for experimention purposes when optimizing blade size and shape for different particulate materials 102, and also permits the intermixing of different blade configurations as may sometimes be desired.

As shown in FIGS. 3–6, each blade sector 120 includes, in addition to blade 124, a flat base portion 126, to an outer end region of which is connected a lower end the associated blade, as is more particularly described below. Blade sector portions 126 are configured so that upon interconnection of all blade sectors 120 by ring 122, a central, circular aperture 128 (FIGS. 3 and 6) is defined, through which, upon assembly of appparatus 14, shaft 74 extends. An annular recess 130 (FIG. 6) is formed downwardly into blade sector portion 126, outwardly adjacent to aperture 128, a narrow, circular, upwardly projecting ridge or key 132 being left in about the radial center of the recess. Key 132 is concentric with aperture 128 and, upon assembly of apparatus 14, is also concentric with vertical axis 52. Interconnecting ring 122 is formed to fit downwardly into blade sector recess 130, a circular groove or keyway 134 being formed upwardly into the ring in such a location that key 132 fits up into the keyway. Key 132 on blade sector portions 126 and keyway 134 on ring 122 facilitate assembly of blade assembly 76 and additionally help retain the sector portions against radial movement during apparatus operation.

Blade sectors 120 are detachably mounted to ring 122 by two circular rows of bolts 136 which extend through aligned apertures 138 in both the ring and the blade sectors. Ring 122 has a central aperture 140 which enables the ring to fit closely over shaft 74, the ring being rigidly attached to the shaft, as by welding around aperture 140. A plurality of triangular, stabilizing gussets 142 (FIGS. 3 and 6) are attached, also as by welding, between ring 122 and shaft 74 to maintain orthogonality between mixer blade assembly 76 and the shaft.

A converging stiffening member 144, having a side angle about equal to the mixer blade inclination angle, $A_1$, discussed below, may be connected by, bolts 145 (FIG. 6), to the under side of blade assembly portion 126 adjacent to the outer edge of ring 122. Member 144, if used, provides additional mechanical rigidity to blade assembly 76.

Figure 7:
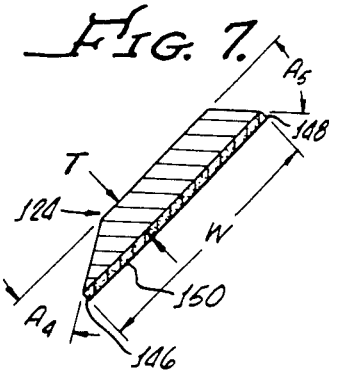
FIG. 7 is a transverse cross-sectional view, taken along line 7—7 of FIG. 6, showing the beveling of the leading and trailing edges of a representative one of the blades.

Mixer blades 124, while being very strong and rigid, are, as best shown in FIGS. 5–7, relatively long, narrow and thin, having a length, L, a width, W, and a thickness, T, examples of which are given hereinbelow. In outline, blades 124 have generally the shape of a parallelogram, with blade leading and trailing edges 146 and 148, respectively, being therefore parallel. In transverse cross section (FIG. 7), blades 124 are generally trapezoidal in shape as a result of leading and trailing edges 146 and 148 thereof being beveled, as described below, to reduce friction between the blades and the particulate material being mixed thereby.

The configuration of mixer blade assembly 76 can best be characterized by several important angles which define the orientation of blades 124 relative to blade sector portions 126 to which the blades are connected. These important blade angles, shown in FIGS. 5–7, are: (i) a blade inclination angle, $A_1$, (FIG. 6) which is the angle an inwardly facing surface 150 of any blade 124 makes relative to a plane orthogonal to apparatus axis 52, that is, relative to a horizontal plane when axis 52 is vertical, (ii) a blade attack angle, $A_2$, (FIG. 5) which is the angle, laying in a plane orthogonal to axis 52, which inwardly facing blade surface 150 makes with a tangent, Tan, drawn to a circle of radius, R, centered at axis 52, and passing through a point "B" at the intersection of blade leading edge 146 with blade sector portion 126, (iii) a blade leading edge-to-base angle, $A_3$, (FIG. 5) between blade leading edge 146 and blade sector portion 126 at point "B" of the blade, (iv) a blade leading edge bevel angle, $A_4$, (FIG. 7), and (v) a blade trailing edge bevel angle, $A_5$, (FIG. 7).

Also important to the characterization of mixer blade assembly 76 is a minimum separation distance, $d_1$, between adjacent blades 124 of mixer blade assembly 76 (FIG. 5), as described more particularly below in relation to particle size to be mixed by blade assembly 76. Still other parameters important to the characterization of apparatus 14, and shown in FIG. 3, are the slope angle, $A_6$, of the sidewall of vessel 58, a preferred maximum separation distance, $d_2$, between distal ends of blades 124 and the sidewall of the vessel, and a diameter, D, of the vessel sidewall in the plane of the distal end of the blades, that is, the vessel diameter at which the blade tip-to-vessel wall separation distance, $d_2$, is measured. These parameters are more particularly discussed below.

The present inventors have also determined that the manner in which particulate material 102 is introduced into apparatus 14, through conduits 16 affects the mixing of the material by apparatus 14, and thus also the cooling provided by the apparatus. For example, if all of the material 102 is introduced in a non-symmetrical manner into one side region of upper vessel 54, as is depicted in FIGS. 2 and 3, the material tends to flow in a non-uniform manner through vessels 54, 56 and 58 and may, therefore, be more difficult to mix and cool in a uniform manner. To provide a more uniform distribution of particulate material 102, particularly in the non-symmetrical feeding arrangement of conduits 16 depicted, a partial elliptically-shaped flow spreader flat plate 156 (FIGS. 2 and 3) is preferably installed at the outlet end of each of conduits 16, in lower conduit regions. Flow spreader plates 156 may, for example, be installed at an angle, $A_7$, which is preferably between about 5° and about 15° relative to an axis 158 through the associated conduit 16, the optimum installation angle of plates 156 depending, however, upon such factors as the geometry of apparatus 14 and the particulate material flow rate through conduits 16. As material 102 flows down conduits 16 onto plates 156 in a cascade flow, the material spreads out horizontally instead of being channeled to one point by the trough shape of the conduits. Substantially the same effect can alternatively be achieved by flattening out lower regions of conduits 16 at the discharge end.

Additional dispersion or spreading of particulate material 102 discharged into apparatus 14 from conduits 16 is provided by an axially short, diverging flow divertor 160 which is mounted around mixer shaft 74 so as to be in the path of material discharged from the conduits. In combination, plates 156 and divertor 160 spread out the flow of particulate material 102 discharged into apparatus 14 through conduits 16 into a more uniformly distributed flow into upper vessel 54.

More specifically, lower vessel 58 is preferably configured to enable the particular type and size of particulate matter 102 to be mixed therein to flow in a packed bed manner through the vessel even when mixer blade assembly is not being driven or even when the blade assembly has been removed. Thus, the packed bed flow of material 102 through lower vessel 58, in combination with the upstream, cascade-type flow of the material through vessels 54 and 56, will provide some material mixing and cooling in the event, for example, of a malfunction of mixer drive assembly 78.

To this end, sidewall angle, $A_6$, of vessel 58 (and also of vessels 54 and 56) is preferred to be between about 30° and about 75°. In a specific case for mixing and cooling hot, retorted oil shale, sidewall angle, $A_6$, is about 73°. Diameter, D, of vessel 58 depends upon such factors as the amount of particulate matter required to be flowed through the vessel and, for an exemplary retorted shale flow of about 1 million pounds per hour, is about 124 inches.

With respect to mixer blade assembly 76, blade inclination angle, $A_1$, (FIG. 6) is preferably between about 30° and about 75°, and within that range the inclination angle is preferred to be within about ±15° of the sidewall angle, $A_6$, of lower vessel 58, although, it is even more preferred that angle, $A_1$, be about equal to sidewall angle, $A_6$.

It is to be appreciated that although blades 124 are preferably, as shown in FIGS. 3–6, straight, it is within the scope of the invention for the blades, or some of the blades, to be arcuate in shape. In such case, inclination angle, $A_6$, should be considered as the average inclination angle of the blades. Also, it is preferred that all blades 124 have the same inclination angle (or average inclination angle, in the case of arcuate blades), $A_6$.

Blade angle of attack, $A_2$, (FIG. 5) is preferably between about 20° and about 60°, and is more preferably about 45°. As shown in FIGS. 4–6, blades 124 are flat and are configures so that at each point along the entire blade length, L, the blade has the same attack angle, $A_2$. It is, however, within the scope of the invention for blades 124 to be formed so that the attach angle is not the same along the entire blade length; in such case, the attack angle, $A_2$, should be considered as being the average attack angle of the blade. Also, it is preferred that all blades 124 have the same attack angle (or average attack angle), $A_2$.

It has been determined by the present inventors that, at least for hot shale mixing and cooling, each blade should have a constant angle of attack, $A_2$, along its entire length, L. In order to achieve such a constant blade angle of attack, it has further now been determined that there is a definite relationship between the blade leading edge-to-base angle, $A_3$, and the blade inclination angle, $A_1$, and the blade angle of attack, $A_2$. This relationship is given by the following expression:

$$A_3 = \text{Arctan}\,[\tan(90° - A_2)/\cos A_1]. \quad (1)$$

Blade leading edge bevel angle, $A_4$, (FIG. 7) is preferably as small as practical, given a particular blade strength and wear characteristics, so as to reduce mixer driving torque. Ordinarily, for most blades 124, bevel angle, $A_4$, is preferred to be between about 20° and about 60°, and it more preferably about 30°. Trailing edge bevel angle, $A_5$, is preferably about 45° to reduce blade drag.

Length, L, (FIG. 6) of blades 124 is preferably related to diameter, D, of vessel 58 in the region of distal ends of the blades in accordance with the equation:

$$L = K_1 D, \quad (2)$$

wherein $K_1$ is a blade length factor which is preferably between about 0.15 and about 0.35, and is more preferably about 0.24. Accordingly, for the exemplary vessel diameter, D, of about 124 inches at the blade tip region, blade length, L, is preferably about 30 inches. Blade width, W, (measured from leading edge 146 to trailing edge 148), and blade thickness, T, corresponding to a blade length of about 30 inches, are about 10 inches and about 1½ inches, respectively. For longer or shorter blades, blade width, W, and thickness, T, may be increased or decreased, depending upon such factors as strength of the blade material and mixer driving torque. Also, for a vessel diameter of about 124 inches at the blade tips, radius, R, from axis 52 to point B at leading edge 146 of blades 124 is preferably about 40 inches.

In order to provide good mixing by blades 124 of material 102, it is preferred that a minimum spacing distance, $d_1$, (FIG. 5) between adjacent blades be substantially greater than the maximum particle size, $P_{max}$, of particles which are to be mixed by blade assembly 76, Accordingly, the preferred minimum blade separation distance can be expressed as follows:

$$d_1 = K_2 P_{max}, \quad (3)$$

wherein $K_2$ is a blade separation factor which is preferably at least about 3. Otherwise, the blade separation distance, $d_1$, is determined by the number of blades 124.

Blade tip maximum spacing distance, $d_2$, between distal ends (that is, tips) of blades 124 and surrounding inner surfaces of vessel 58 is preferably no more than about one foot, when vessel diameter, D, is about 124 inches. More preferably, the blade tips are no more than about 6 inches form the vessel wall. It is also preferred, for good mixing, that tips of blades be at about surface 160 of material 102 in vessel 58, as is shown in FIG. 3. Otherwise, it is preferred that for a vessel 58 of the mentioned size, that tips of blades 124 be submerged no more than about one foot below material surface 160.

Blade assembly 76 may be constructed of stainless steel and blade surfaces 150, as well as upper surface of blade sector portions 126, may advantageously be coated with a layer, about ⅜ inch thick, of an abrasion resistant material, such as TRITEN T200X.

Although there has been described above a particular embodiment of a mixing and cooling apparatus in accordance with the preferred embodiment of the present invention for purposes of illustrating how the invention may be used to advantage, it is to be appreciated that the invention is not limited thereto. For example, as mentioned above, blades 124 may differ in size and shape from one another, as may the inclination, attack, rake, and bevel angles, $A_1$–$A_6$ for the various blades. Although a symmetrical arrangement of blades 124 is preferred, the arrangement may be non-symmetrical. Mixer blade assemblies 76 may be installed in all of vessels 54, 56 and 58 or may be installed in vessels other than lower vessel 58. Also, mixing may be achieved by apparatus 14 without the use of water cooling means 100 when cooling of material 102 is not required.

Accordingly, any and all modifications and variations which may occur to those skilled in the art are to be considered to be within the scope and spirit of the invention as defined by the appended claims.

What is claimed is:

1. Apparatus for packed bed, gravity flow mixing of particulate matter, the apparatus comprising:

a. a mixing vessel having a vertical axis having a particulate matter inlet opening in upper regions and a particulate matter discharge opening in lower regions;

b. mixing means disposed in said vessel for mixing a packed bed of particulate matter flowing therethrough, said mixing means including:

i. a mixer shaft rotatably mounted along said vessel vertical axis, said shaft having a first portion disposed inside a packed bed flow region of the vessel and a second portion disposed outside of said packed bed flow region;

ii. a plurality of similar mixing blades;

iii. means connecting said mixing blades to the shaft second portion so that each of the blades is upwardly and outwardly inclined at an average inclination angle which is at least about 30° with respect to a plane orthogonal to said vertical axis; and iv. means disposed upstream of the mixing blades and inwardly of major portions of the blades for at least partially supporting the weight of particulate matter in the vessel and for diverting the particulate matter outwardly towards said mixing blades as the blades are rotated; and c. means connected to said shaft second portion for causing rotation of said shaft and the mixing blades connected thereto in a given mixing direction.

2. The particulate matter mixing apparatus as claimed in claim 1 wherein the number of mixing blades is between about 4 and about 8 and wherein said blade connecting means connect the blades to the shaft second portion in a symmetrical manner and at substantially equal angular spacings.

3. The particulate matter mixing apparatus as claimed in claim 1 wherein said average inclination angle is substantially the same for each of the mixing blades and is between about 30° and about 75°.

4. The particulate matter mixing apparatus as claimed in claim 3 wherein said vessel has converging sidewalls and wherein the average inclination angle, $A_1$, of the mixing blades is within about ±15° of the angle at which the vessel sidewalls converge.

5. The particulate matter mixing apparatus as claimed in claim 1 wherein the leading edge of each of said blades with respect to its direction of rotation has an average attack angle of at least about 20° with respect to a tangent of an arc which originates at said vertical axis and is in a plane orthogonal thereto and which passes through said leading edge.

6. The particulate matter mixing apparatus as claimed in claim 5 wherein the average attack angle is substantially the same for all the mixing blades and is between about 30° and about 60°.

7. The particulate matter mixing apparatus as claimed in claim 5 wherein said average attack angle is about 45°.

8. The particulate matter mixing apparatus as claimed in claim 5 wherein each of said mixing blades has substantially parallel inwardly and outwardly facing surfaces.

9. The particulate matter mixing apparatus as claimed in claim 8 wherein the outwardly facing surface of each of said mixing blades is beveled at least at the leading edge of the blade.

10. The particulate matter mixing apparatus as claimed in claim 9 wherein the bevel angle at the leading edge of each of said mixing blades is between about 20° and about 60°.

11. The particulate matter mixing apparatus as claimed in claim 9 wherein the outwardly facing surface of said mixing blade is beveled at the trailing edge of the blade.

12. The particulate matter mixing apparatus as claimed in claim 11 wherein the bevel angle at the trailing edge of the blades is about 45°.

13. The particulate matter mixing apparatus as claimed in claim 1 wherein the average separation distance between the distal end region of any of the mixing blades and adjacent inner surface regions of the vessel as the mixing shaft is rotated is no greater than about one foot.

14. The particulate matter mixing apparatus as claimed in claim 1 wherein at least some of the mixing blades are configured having a blade angle between the leading edge of the blade and the base of the blade which is a function of the average angle on inclination and the average attack angle of the associated blade.

15. The particulate matter mixing apparatus as claimed in claim 14 wherein said blade angle is related to said angles of inclination and attack in accordance with the following relationship:

$$A_3 = \text{Arctan}\,[\tan(90° - A_2)/\cos A_1],$$

wherein $A_1$ is said average angle of inclination, $A_2$ is said average attack angle and $A_3$ is said blade angle.

16. The particulate matter mixing apparatus as claimed in claim 1 wherein each of said mixing blades has a mixing length, L, which is determined by the relationship:

$$L = K_1 D,$$

wherein D is the average transverse cross-sectional diameter of the mixing vessel in the region of distal ends of the blades and wherein $K_1$ is a blade length factor of between about 0.15 and about 0.35.

17. The particulate matter mixing apparatus as claimed in claim 16 wherein the blade length factor, $K_1$, is about 0.24.

18. The particulate matter mixing apparatus as claimed in claim 1 wherein the minimum separation distance, $d_1$, between any pair of adjacent mixing blades is determined by the relationship:

$$d_1 = K_2 P_{max},$$

wherein $P_{max}$ is the maximum cross-sectional dimension of particles matter to be mixed by the apparatus and wherein $K_2$ is a blade separation factor of at least about 3.

19. The particulate matter mixing apparatus as claimed in claim 1 wherein the plan view shape of each of the mixing baldes is substantially a parallelogram.

20. The particulate matter mixing apparatus as claimed in claim 1 including means for introducing a cooling fluid onto particulate matter flowing through the vessel.

21. The particulate matter mixing apparatus as claimed in claim 1 including means for introducing water onto particulate matter flowing through the vessel.

22. The particulate matter mixing apparatus as claimed in claim 1 wherein the means for supporting the weight of particulate matter and for the diverting thereof outwardly towards the mixing blades comprises a truncated cone mounted above the mixing blades.

23. The particulate matter mixing apparatus as claimed in claim 1 wherein the means for supporting the weight of particulate matter and for the diverting thereof outwardly towards the mixing blades comprises a disc attached to the mixing shaft second portion, said mixing blades being connected to outer peripheral regions of said disc.

24. Apparatus for packed bed, gravity flow mixing of particulate matter, the apparatus comprising:

a. a mixing vessel having a vertical axis, having converging sidewalls, and having a particulate matter inlet opening in upper regions and a particulate matter discharge opening in lower regions;

b. mixing means disposed in said vessel for mixing a packed bed of particulate matter flowing therethrough, said mixing means including:

i. a mixer shaft rotatably mounted along said vessel vertical axis, said shaft having a first portion disposed inside a packed bed flow region of the vessel and a second portion disposed outside of said packed bed flow region;

ii. a plurality of similar mixing blades;

iii. means connecting said mixing blades to the shaft second portion in a symmetrical manner so that each of the blades is upwardly and outwardly inclined at an average inclination angle of at least about 30° with respect to a plane orthogonal to said vertical axis and so that the leading edge of each of said blades with respect to its direction of rotation has an average attack angle of at least about 20° with respect to a tangent of a horizontal arc which originates at said vertical axis and which passes through said leading edge; and iv. means disposed upstream of the mixing blades and inwardly of major portions of the blades for at least partially supporting the weight of particulate matter in the vessel and for diverting the particulate matter outwardly towards said mixing blades as the blades are rotated; and c. means connected to said shaft second portion for causing rotation of said shaft and the mixing blades connected thereto in a given mixing direction.

25. The particulate matter mixing apparatus as claimed in claim 24 wherein said average inclination angle is substantially the same for all of the mixing blades and is between about 30° and about 75° and wherein said average angle of attack is substantially the same for all the mixing blades and is also between about 30° and about 60°.

26. The particulate matter mixing apparatus as claimed in claim 25 wherein the average inclination angle is within about ±15° of the angle at which the sidewalls of the vessel converge.

27. The particulate matter mixing apparatus as claimed in claim 25 wherein the average attack angle is about 45°.

28. The particulate matter mixing apparatus as claimed in claim 24 wherein outwardly directed surfaces of said mixing blades are beveled at the blade leading and trailing edges.

29. The particulate matter mixing apparatus as claimed in claim 28 wherein the leading edge bevel angle is between about 20° and about 60° and wherein the trailing edge bevel angle is equal to about 45°.

30. The particulate matter mixing apparatus as claimed in claim 24 wherein each of the mixing blades has a mixing length, L, determined by the relationship:

$$L = K_1 D,$$

wherein D is the average transverse cross-sectional diameter of the mixing vessel in the region of distal ends of the blades and wherein $K_1$ is a blade length factor of between about 0.15 and about 0.35, and wherein the minimum separation distance, $d_1$, between any pair of adjacent mixing blades is determined by the relationship:

$$d_1 = K_2 P_{max},$$

wherein $P_{max}$ is the maximum expected cross-sectional dimension of particles to be mixed by the apparatus and wherein $K_2$ is a blade separation factor of at least about 3.

31. The particulate matter mixing apparatus as claimed in claim 24 wherein at least some of the mixing blades are configured having a blade angle between the leading edge of the blade and the base of the blade which related to the average angle on inclination and the average attack angle of the associated blade in accordance with the following relationship:

$$A_3 = \text{Arctan}\,[\tan(90° - A_2)/\cos A_1],$$

wherein $A_1$ is said average angle of inclination, $A_2$ is said average attack angle and $A_3$ is said blade angle.

32. The particulate mixing apparatus as claimed in claim 24 including means for introducing a water onto particulate matter flowing through the mixing vessel.

33. Apparatus for packed bed, gravity flow mixing of particulate matter, the apparatus comprising:

a. a mixing vessel having converging sidewalls, having a vertical axis and having a particulate matter inlet opening in upper regions and a particulate matter discharge opening in lower regions;

b. mixing means disposed in said vessel for mixing a packed bed of particulate matter flowing therethrough, said mixing means including:

i. a mixer shaft rotatably mounted along said vessel vertical axis, said shaft having a first portion disposed inside a packed bed flow region of the vessel and a second portion disposed outside of said packed bed flow region;

ii. a plurality of similar mixing blades each having a substantially straight particle mixing region with a substantially straight leading edge;

iii. means connecting said mixing blades to the shaft second portion at equal angular spacings and so that the particle mixing region of each of the blades is upwardly and outwardly inclined at an inclination angle of between about 30° and about 75° with respect to a plane orthogonal to said vertical axis and so that the leading edge of the particle mixing region of each of said blades with respect to its direction of rotation is in a different plane through said vertical axis and has an attack angle of between about 30° and about 60° with respect to a tangent of a horizontal arc which originates at said vertical axis and which passes through said leading edge; and iv. means disposed upstream of the mixing blades and inwardly of major portions of the blades for at least partially supporting the weight of particulate matter in the vessel and for diverting the particulate matter outwardly towards said mixing blades as the blades are rotated; and c. means connected to said shaft second portion for causing rotation of said shaft and the mixing blades connected thereto in a preestablished mixing direction.

34. The particulate matter mixing apparatus as claimed in claim 33 wherein the average inclination angle is about 60°.

35. The particulate matter mixing apparatus as claimed in claim 33 wherein the average attack angle is about 45°.

36. The particulate matter mixing apparatus as claimed in claim 33 wherein an outwardly directed surface of the particle mixing region of each of said mixing blades is beveled at the blade leading at an angle of between about 20° and about 60°.

37. The particulate matter mixing apparatus as claimed in claim 33 wherein each of the mixing blades has a mixing length, L, determined by the relationship:

$$L=K_1 D,$$

wherein D is the average transverse cross-sectional diameter of the mixing vessel in the region of distal ends of the blades and wherein $K_1$ is a blade length factor of between about 0.15 and about 0.35, and wherein the minimum separation distance, $d_1$, between any pair of adjacent mixing blades is determined by the relationship:

$$d_1=K_2 P_{max},$$

wherein $P_{max}$ is the maximum expected cross-sectional dimension of particles to be mixed by the apparatus and wherein $K_2$ is a blade separation factor of at least about 3.

38. The particulate matter mixing apparatus as claimed in claim 1 wherein at least some of the mixing blades are configured having a blade angle bewteen the leading edge of the blade and the base of the blade which related to the average angle on inclination and the average attack angle of the associated blade in accordance with the following relationship:

$$A_3=\text{Arctan}\,[\tan(90°-A_2)/\cos A_1],$$

wherein $A_1$ is said average angle of inclination, $A_2$ is said average attack angle and $A_3$ is said blade angle.

39. The particulate mixing apparatus as claimed in claim 33 including means for introducing a water onto particulate matter flowing through the mixing vessel.

40. The particulate matter mixing apparatus as claimed in claim 33 including at least one cascade flow mixing vessel having an outlet opening from which particulate matter flows into the inlet opening of said vessel, an particulate matter conduit positioned for discharging particulate matter into said vessel and means for spreading the flow of particulate matter from said conduit into said vessel.

41. The particulate matter mixing apparatus as claimed in claim 40 wherein said conduit discharges particulate matter into said vessel at an angle of substantially less than 90° relative to a horizontal plane through said vertical axis and wherein said flow spreading means comprise a partially elliptically-shaped, substantially flat, flow deflecting surface within said conduit upstream adjacent to a flow discharge opening in the conduit.

42. Apparatus for gravity flow mixing of particulate matter, the apparatus comprising:

a. a plurality of gravity flow, particulate matter mixing vessels with converging sidewalls, said vessels being arranged along a vertical axis in gravity flow series, the uppermost one of said chambers having a particulate matter conduit discharging into an inlet opening therein and the bottom-most one of the chambers having a particulate matter discharge opening therein;

b. mechanical mixing means disposed in at least one of said plurality of mixing chambers for mixing a packed bed of particulate matter flowing therethrough, said mixing means including:

i. a mixer shaft rotatably mounted along said vertical axis, said shaft having a first portion disposed inside a packed bed flow region of said at least one vessel and a second portion disposed outside of said packed bed flow region;

ii. a plurality of similar mixing blades;

iii. means connecting said mixing blades to the shaft second portion in a symmetrical manner so that each of the blades is upwardly and outwardly inclined at an average inclination angle of at least about 30° with respect to a plane orthogonal to said vertical axis and so that the leading edge of each of said blades with respect to its direction of rotation has an average attack angle of at least about 20° with respect to a tangent of a horizontal arc which originates at said vertical axis and which passes through said leading edge; and iv. means disposed upstream of the mixing blades and inwardly of major portions of the blades for at least partially supporting the weight of particulate matter in the vessel and for diverting the particulate matter outwardly towards said mixing blades as the blades are rotated; and c. means connected to said shaft second portion for causing rotation of said shaft and the mixing blades connected thereto in a preestablished mixing direction.

43. The particulate matter mixing apparatus as claimed in claim 42 wherein said average inclination angle is substantially the same for all of the mixing blades and is between about 30° and about 75° and wherein said average angle of attack is substantially the same for all the mixing blades and is between about 30° and about 60°.

44. The particulate matter mixing apparatus as claimed in claim 43 wherein the average inclination angle is about 60°.

45. The particulate matter mixing apparatus as claimed in claim 42 wherein the average attack angle is about 45°.

46. The particulate matter mixing apparatus as claimed in claim 42 wherein outwardly directed surfaces of said mixing blades are beveled at the blade leading and trailing edges.

47. The particulate matter mixing apparatus as claimed in claim 46 wherein the leading edge bevel angle is between about 20° and about 69° and wherein the trailing edge bevel angle is equal to about 45°.

48. The particulate matter mixing apparatus as claimed in claim 42 wherein each of the mixing blades has a mixing length, L, determined by the relationship:

$$L = K_1 D,$$

wherein D is the average transverse cross-sectional diameter of the mixing vessel in the region of distal ends of the blades and wherein $K_1$ is a blade length factor of between about 0.15 and about 0.35, and wherein the minimum separation distance, $d_1$, between any pair of adjacent mixing blades is determined by the relationship:

$$d_1 = K_2 P_{max},$$

wherein $P_{max}$ is the maximum expected cross-sectional dimension of particles to be mixed by the apparatus and wherein $K_2$ is a blade separation factor of at least about 3.

49. The particulate matter mixing apparatus as claimed in claim 42 wherein the leading edge of mixing regions of each of the mixing blades lies substantially in a plane through said vertical axis.

50. The particulate mixing apparatus as claimed in claim 42 including means for introducing a cooling fluid onto particulate matter flowing through said at least one mixing vessel.

51. The particulate matter mixing apparatus as claimed in claim 42 wherein said at least one of the mixing chambers is the bottom-most one of said chambers and wherein the mixing chambers thereabove are configured for the cascade flow of particulate matter therethrough.

52. The particulate matter mixing apparatus as claimed in claim 42 wherein at least some of the mixing blades are configured having a blade angle between the leading edge of the blade and the base of the blade which related to the average angle on inclination and the average attack angle of the associated blade in accordance with the following relationship:

$$A_3 = \text{Arctan}\,[\tan(90° - A_2)/\cos A_1],$$

wherein $A_1$ is said average angle of inclination, $A_2$ is said average attack angle and $A_3$ is said blade angle.

53. The particulate matter mixing apparatus as claimed in claim 42 wherein the average separation distance between the distal ends of the mixing blades and the adjacent inner surface of said at least one mixing vessel is less than about one foot.

54. The particulate matter mixing apparatus as claimed in claim 42 wherein said conduit discharges particulate matter into the uppermost vessel at an angle of substantially less than 90° relative to a horizontal plane through said vertical axis and including a flat, partially elliptically-shaped flow deflecting surface within said conduit upstream adjacent to a flow discharge opening in the conduit.

* * * * *